US011640872B2

(12) United States Patent
Sato et al.

(10) Patent No.: US 11,640,872 B2
(45) Date of Patent: May 2, 2023

(54) METHOD FOR MANUFACTURING COIL COMPONENT

(71) Applicant: TAIYO YUDEN CO., LTD., Tokyo (JP)

(72) Inventors: Kazuyoshi Sato, Takasaki (JP); Masashi Tsukui, Takasaki (JP); Masashi Mogi, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 714 days.

(21) Appl. No.: 16/715,760

(22) Filed: Dec. 16, 2019

(65) Prior Publication Data

US 2020/0211752 A1 Jul. 2, 2020

(30) Foreign Application Priority Data

Dec. 28, 2018 (JP) ..... JP2018-248306

(51) Int. Cl.

| | |
|---|---|
| ***H01F 41/06*** | (2016.01) |
| ***H01F 41/074*** | (2016.01) |
| ***H01F 27/29*** | (2006.01) |
| *H01F 17/00* | (2006.01) |

(52) U.S. Cl.

CPC ..... *H01F 27/292* (2013.01); *H01F 41/06* (2013.01); *H01F 41/074* (2016.01); *H01F 2017/0093* (2013.01)

(58) Field of Classification Search

CPC ..... H01F 41/06; H01F 41/074

See application file for complete search history.

(56) References Cited

U.S. PATENT DOCUMENTS

| | | | | |
|---|---|---|---|---|
| 2,173,091 | A * | 9/1939 | Armstrong | H01F 41/06 242/482.6 |
| 2003/0030526 | A1 | 2/2003 | Hirai et al. | |
| 2004/0172806 | A1* | 9/2004 | Yoshimori | H01F 41/098 29/605 |
| 2005/0212644 | A1* | 9/2005 | Yoshimori | H01F 5/02 336/224 |

(Continued)

FOREIGN PATENT DOCUMENTS

| | | | |
|---|---|---|---|
| JP | 2003124031 | A | 4/2003 |
| JP | 2008085375 | A * | 4/2008 |

(Continued)

*Primary Examiner* — Peter Dungba Vo
*Assistant Examiner* — Jose K Abraham
(74) *Attorney, Agent, or Firm* — Law Office of Katsuhiro Arai

(57) ABSTRACT

A method for manufacturing a coil component includes: a first winding step to wind a first conductive wire around a winding core in a single layer from a first flange part toward a second flange part; and a second winding step to wind a second conductive wire around the winding core on the first conductive wire by the same number of turns and in the same direction as in the first winding step in a single layer in a manner that center B of the cross-section of the second conductive wire closest to the first flange part is positioned closer to the first flange part than is center A of the cross-section of the first conductive wire closest to the first flange part, and that the distance in the axial direction, between centers A and B is smaller than the radius of the wire.

7 Claims, 9 Drawing Sheets

(56) References Cited

U.S. PATENT DOCUMENTS

| | | | | |
|---|---|---|---|---|
| 2008/0223974 | A1* | 9/2008 | Ueki | H01F 5/00 242/433 |
| 2013/0186995 | A1* | 7/2013 | Yamaguchi | H01F 17/045 242/432.6 |
| 2014/0167903 | A1* | 6/2014 | Tomonari | H01F 27/2823 336/220 |
| 2017/0092410 | A1* | 3/2017 | Sado | H01F 27/292 |
| 2017/0169935 | A1 | 6/2017 | Miyamoto et al. | |

FOREIGN PATENT DOCUMENTS

| | | | | | |
|---|---|---|---|---|---|
| JP | 2010147132 | A | | 7/2010 | |
| JP | 2011077183 | A | * | 4/2011 | |
| JP | 2011216681 | A | | 10/2011 | |
| JP | 2014199904 | A | | 10/2014 | |
| JP | 2017112156 | A | | 6/2017 | |
| WO | WO-2016199893 | A1 | * | 12/2016 | H01F 27/28 |

* cited by examiner

METHOD FOR MANUFACTURING COIL COMPONENT

CROSS-REFERENCE TO RELATED APPLICATIONS

The present application claims priority to Japanese Patent Application No. 2018-248306, filed Dec. 28, 2018, the disclosure of which is incorporated herein by reference in its entirety including any and all particular combinations of the features disclosed therein.

BACKGROUND

Field of the Invention

The present invention relates to a method for manufacturing a coil component.

Description of the Related Art

Coil components, each comprising multiple conductive wires wound around a winding core that constitutes a drum core, are known. For example, it is known that, by winding multiple conductive wires around a winding core in such a way that they are lined up in a single layer from one to the other of a pair of flange parts connected to both ends of the winding core, a wide variety of inductance values can be obtained (refer to Patent Literature 1, for example). Also, the following is known: connect multiple conductive wires to an external electrode part of a core through a wire guard or winding nozzle, turn the winding nozzle in a forward direction by a specified number of times to form twisted conductive wire parts above and below the winding nozzle, and turn the core to allow the twisted conductive wire part below the winding nozzle to be wound around the core; subsequently, turn the winding nozzle in the reverse direction to release the twisting of the twisted part above the winding nozzle, while forming a twisted part below the winding nozzle at the same time, and then turn the core to allow the twisted conductive wire part below the winding nozzle to be wound around the core (refer to Patent Literature 2, for example). Also, common mode choke coils, each having a first conductive wire and a second conductive wire that are wound around a winding core by the same number of turns, are known (refer to Patent Literature 3, for example).

Background Art Literatures

[Patent Literature 1] Japanese Patent Laid-open No. 2003-124031

[Patent Literature 2] Japanese Patent Laid-open No. 2010-147132

[Patent Literature 3] Japanese Patent Laid-open No. 2017-112156

SUMMARY

As electronic devices become increasingly smaller, reduction of coil component size is being required. When multiple conductive wires are to be wound around a winding core, desirably they are wound by the same number of turns from the viewpoints of obtaining a desired inductance, or the like. In this case, the region in which the conductive wires are wound may become larger and the drum core size may increase as a result, making it difficult to address the requirement to reduce the coil component size.

The present invention was made in light of the aforementioned problem, and its object is to reduce the coil component size.

The present invention is a method for manufacturing a coil component, comprising: a step to prepare a drum core that includes a winding core, a first flange part provided on one end of the winding core in the axial direction, and a second flange part provided on the other end of the winding core in the axial direction; a first winding step where a first conductive wire, being a round wire, is wound around the winding core by a multiple number of turns in a single layer, from the first flange part toward the second flange part, in such a way that adjacent winding segments of the first conductive wire are contacting each other; and a second winding step where a second conductive wire, being a round wire, is wound around the winding core on an outer periphery of the first conductive wire by the same number of turns as in the first winding step in a single layer, from the first flange part toward the second flange part, in such a way that adjacent winding segments of the second conductive wire are contacting each other; wherein, in the second winding step, the second conductive wire is wound around the winding core in such a way that the center of the axial-direction cross-section of the second conductive wire at the second proximate winding segment which is the winding segment at the start of winding closest to the first flange part, is positioned closer to the first flange part side in the axial direction than is the center of the axial-direction cross-section of the first conductive wire at the first proximate winding segment which is the winding segment at the start of winding closest to the first flange part in the first winding step, and that the spacing in the axial direction, between the center of the cross-section at the first proximate winding segment and the center of the cross-section at the second proximate winding segment, becomes smaller than the equivalent radius of the first conductive wire on the cross-section. In some embodiments, the axial-direction cross-section is typically substantially the same as a radial cross-section where the winding direction is typically substantially perpendicular to the axial direction, wherein the radial cross-section and the axial-direction cross-section may be used interchangeably.

In the aforementioned constitution, it may be constituted in such a way that: the step to prepare a drum core comprises having the winding core have a concaved part positioned away from the first flange part and concaved in a direction crossing the axial direction; the first winding step comprises arranging the first proximate winding segment to fit in the concaved part; and the second winding step comprises arranging the second proximate winding segment to contact the first flange part.

In the aforementioned constitution, it may be constituted in such a way that: the step to prepare a drum core comprises having the winding core have a projecting part contacting the first flange part and projecting in a direction crossing the axial direction; the first winding step comprises arranging the first proximate winding segment to contact the side face, which crosses the axial direction, of the projecting part; and the second winding step comprises arranging the second proximate winding segment to contact the first flange part.

In the aforementioned constitution, it may be constituted in such a way that: the step to prepare a drum core comprises having the winding core have a concaved part that includes a face sloped (inclined) so that the diameter of the winding core decreases for points further away from the first flange part; the first winding step comprises arranging the first proximate winding segment to fit in the concaved part; and the second winding step comprises arranging the second proximate winding segment to contact the first flange part.

In the aforementioned constitution, it may be constituted in such a way that: the step to prepare a drum core comprises having the interior face, to which the winding core is connected, of the first flange part have a sloped (inclined) shape so that the thickness of the first flange part in the axial direction increases for points closer to the winding core; the first winding step comprises arranging the first proximate winding segment to contact the interior face of the first flange part; and the second winding step comprises arranging the second proximate turned winding segment to contact the interior face of the first flange part.

In the aforementioned constitution, it may be constituted in such a way that: a step to form a spacer part in contact with the first flange part around the winding core is provided before the first winding step; a step to remove the spacer part is provided after the first step and before the second winding step; the first winding step comprises arranging the first proximate winding segment to contact the side face, which crosses the axial direction, of the spacer part that has been formed in contact with the first flange part around the winding core; and the second winding step comprises arranging the second proximate winding segment to contact the first flange part after the spacer part has been removed.

According to the present invention, the coil component size can be reduced.

BRIEF DESCRIPTION OF THE DRAWINGS

FIG. 9A is a plan view, while

DESCRIPTION OF THE SYMBOLS

Figure 1A:
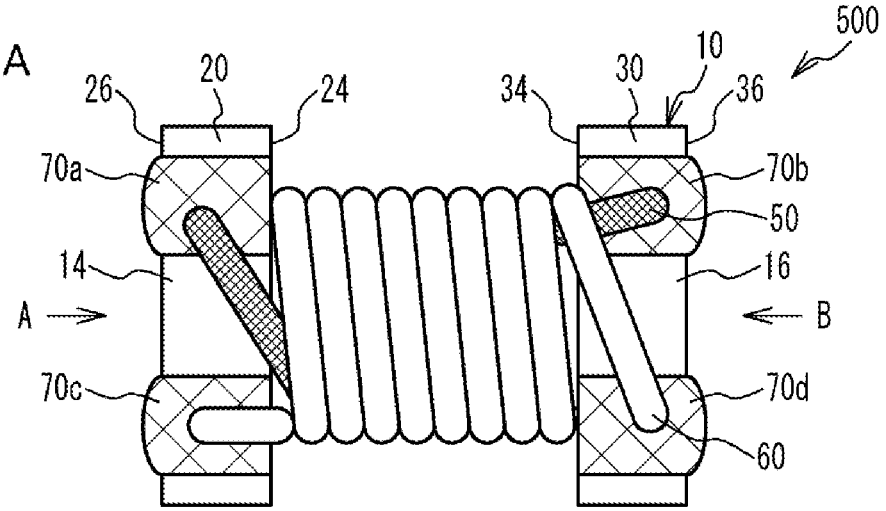
FIG. 1A is a plan view.

10 Drum core
12, 12*a*, 12*b*, 12*c* Winding core
14, 14*a* Flange part
16, 16*a* Flange part
20, 30 Connection face
22, 32 Mounting face
24, 34 Interior face
26, 36 Exterior face
40 Concaved part
42 Projecting part
44 Concaved part
46 Spacer part
50 Conductive wire
52 Proximate winding segment
54 Center
60 Conductive wire
62 Proximate winding segment
64 Center
66 Last winding segment
70*a* to 70*d* Terminal electrode
500, 600 Coil component

DETAILED DESCRIPTION OF EMBODIMENTS

Examples of the present invention are explained below by referring to the drawings.

Example 1

Figure 1B:
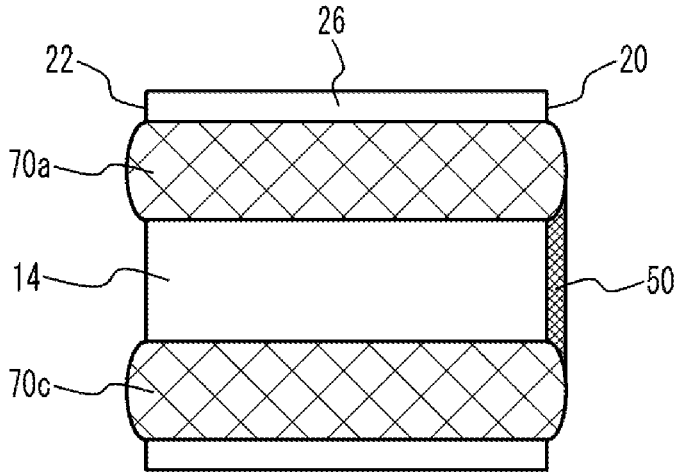
FIG. 1B is a plan view seen from direction A in FIG. A, and FIG. 1 C is a plan view seen from direction B in FIG. 1A, of the coil component pertaining to Example 1.
Figure 1C:
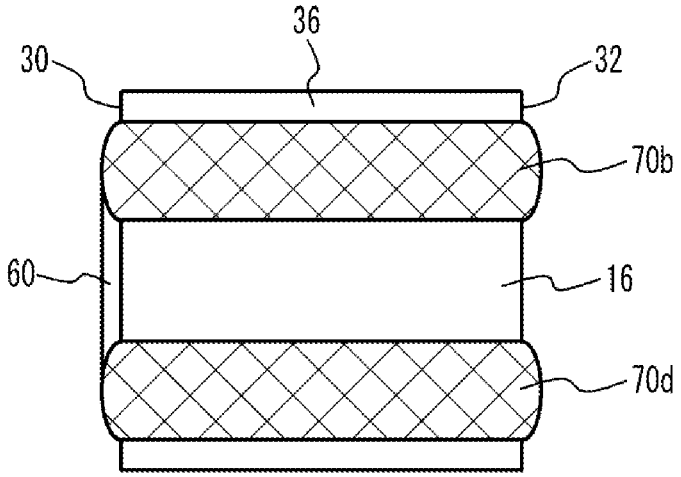
Figure 2A:
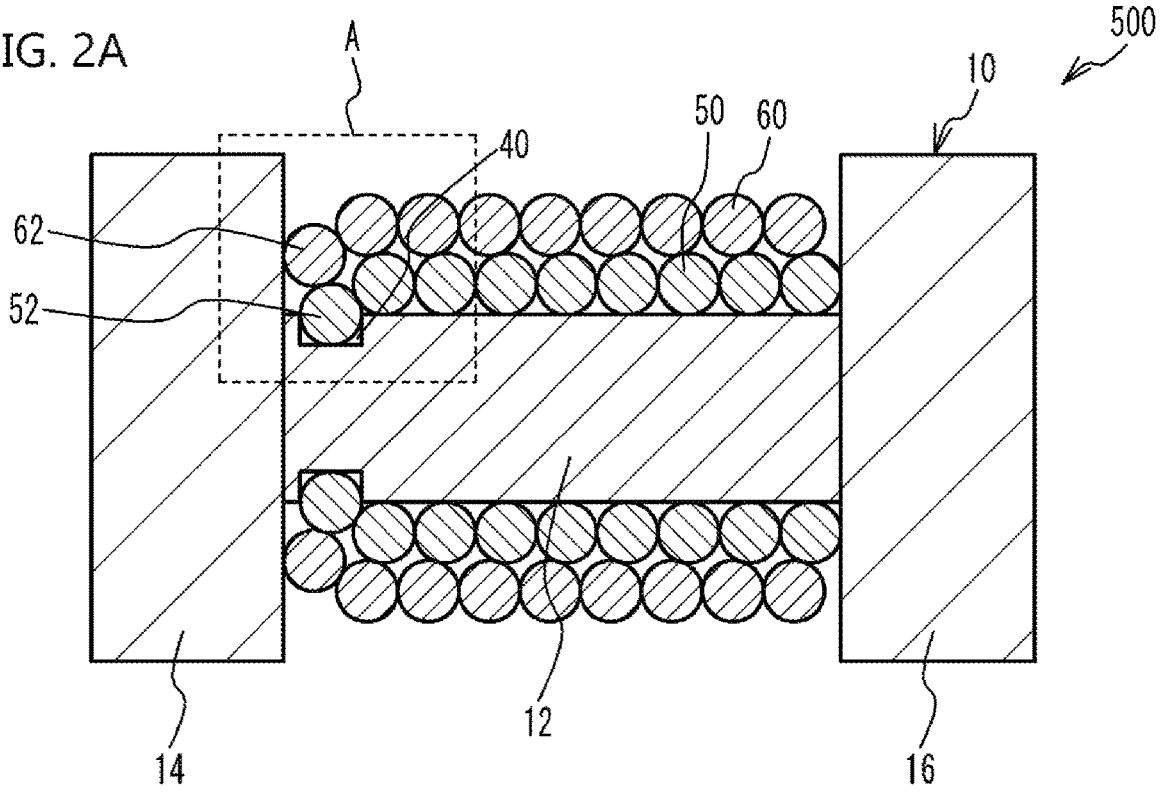
FIG. 2A is a cross-sectional view of the coil component pertaining to Example 1, while FIG. 2 B is an enlarged view of region A in FIG. 2A.
Figure 2B:
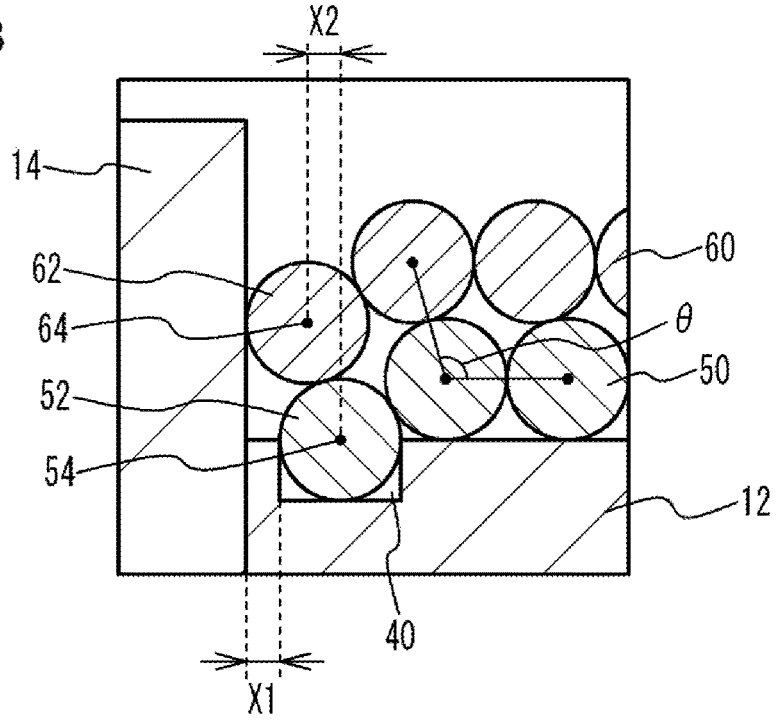

FIG. 1A is a plan view, FIG. 1B is a plan view seen from direction A in FIG. A, and FIG. 1C is a plan view seen from direction B in FIG. 1A, of the coil component pertaining to Example 1. It should be noted that, in FIG. 1A, the illustration of the windings of the conductive wires 50, 60 is simplified for the sake of clarity of figures. Also, in FIGS. 1A to 1C, the conductive wire 50 and terminal electrodes 70*a* to 70*d* are hatched for the sake of clarity of figures. FIG. 2A is a cross-sectional view of the coil component pertaining to Example 1, while FIG. 2B is an enlarged view of region A in FIG. 2A. It should be noted that, in FIG. 2 A, the terminal electrodes 70*a* to 70*d* are not illustrated. As shown in FIGS. 1A to 1C, 2A, and 2B, the coil component 500 in Example 1 is a common mode choke coil comprising a drum core 10, conductive wires 50, 60, and terminal electrodes 70*a* to 70*d*.

The drum core 10 comprises a winding core 12, a flange part 14 provided at one end of the winding core 12 in the axial direction, and a flange part 16 provided at the other end of the winding core 12 in the axial direction. The external dimensions of the drum core 10 are 3.2 mm in length dimension, 2.5 mm in width dimension, and 2.0 mm in height dimension, in one example. The flange parts 14, 16 are shaped as a rectangular solid, for example. The thickness dimensions of the flange parts 14, 16 are approx. 0.2 mm to 0.4 mm, for example. The winding core 12 is shaped as a circular cylinder having a concaved part 40, for example. The length dimension of the winding core 12 is approx. 2.4 mm to 2.8 mm, for example.

The flange part 14 has a connection face 20, a mounting face 22 on the side of the flange part 14 opposite to the connection face 20, an interior face 24 to which the winding core 12 is connected, and an exterior face 26 on the side of the flange part 14 opposite to the interior face 24. The flange part 16 has a connection face 30, a mounting face 32 on the side of the flange part 16 opposite to the connection face 30, an interior face 34 to which the winding core 12 is connected, and an exterior face 36 on the side of the flange part 16 opposite to the interior face 34. The winding core 12 connects to the interior face 24 of the flange part 14 and the interior face 34 of the flange part 16 in such a way that the center axis of the winding core 12 roughly corresponds to the center of the interior face 24 of the flange part 14 and that of the interior face 34 of the flange part 16.

The winding core 12 has a concaved part 40 formed on the flange part 14 side, which is concaved in a direction crossing (such as a direction crossing at right angles) the axial direction of the winding core 12. The concaved part 40 is formed in a manner going all around the winding core 12, for example. The concaved part 40 is away from the flange part 14 and does not contact the flange part 14. The spacing X1 between the concaved part 40 and the flange part 14 is smaller than the radius of the conductive wire 60, for example. The drum core 10 is formed in such a way that it contains a magnetic material. For example, the drum core 10 is formed in such a way that it contains Ni—Zn, Mn—Zn, or other ferrite material, Fe—Si—Cr, Fe—Si—Al, Fe—Si—Cr—Al, or other soft magnetic alloy material, Fe, Ni, or other magnetic metal material, amorphous magnetic metal material, or nanocrystal magnetic metal material.

The conductive wire 50 is wound around the winding core 12 in a single layer. The conductive wire 50 is wound by a multiple number of turns, with adjacent winding segments contacting each other. The conductive wire 50 is wound around the winding core 12 in such a way that its proximate winding segment 52 wound closest to the flange part 14 is fitted in the concaved part 40. The conductive wire 60 is wound around the winding core 12 on the exterior side of the conductive wire 50 in a single layer. The conductive wire 60 is wound by a multiple number of turns, with adjacent winding segments contacting each other. The number of turns by which the conductive wire 60 is wound around the winding core 12 is the same as the number of turns by which the conductive wire 50 is wound around the winding core 12. The conductive wire 60 is wound in such a way that its winding segments, and corresponding winding segments of the conductive wire 50, are contacting each other by 0.5 turns or more. In other words, the conductive wire 60 is wound in such a way that its winding segments are in contact, at least partially, with those of the conductive wire 50 in turns representing the same numbers of turns. The conductive wire 50, and the conductive wire 60, are positioned away from each other at the winding segments representing different numbers of turns.

The conductive wire 60 is wound around the winding core 12 in such a way that the center 64 of the cross-section at the proximate winding segment 62 wound closest to the flange part 14, is positioned closer to the flange part 14 side in the axial direction than is the center 54 of the cross-section at the proximate winding segment 52 of the conductive wire 50. The proximate winding segment 62 of the conductive wire 60 is contacting the flange part 14. The spacing X2 in the axial direction, between the center 54 of the cross-section at the proximate winding segment 52 of the conductive wire 50 and the center 64 of the cross-section at the proximate winding segment 62 of the conductive wire 60, is smaller than the radius of the conductive wire 50. Also, the angle θ formed by a line segment connecting the centers of adjacent winding segments of the conductive wire 50, and a line segment connecting the center of the winding segment on the flange part 14 side of the adjacent winding segments, and the center of the winding segment of the conductive wire 60 representing the same turn as the aforementioned winding segment, is greater than 90° but smaller than 120°. The formed angle θ may be 95° or greater but no greater than 115°, or 100° or greater but no greater than 110°. It should be noted that, if the center of the winding segment (referred to as the "second winding segment") of the conductive wire 60 representing the same turn as the winding segment on the flange part 14 side (referred to as "first winding segment") of the adjacent winding segment of the conductive wire 50, is positioned closer to the flange part 16 side in the axial direction of the winding core 12 than is the center of the first winding segment, then the formed angle θ becomes smaller than 90°.

The conductive wires 50, 60 are round wires whose cross-section has a circular shape. The diameters of the conductive wires 50, 60 are approx. 0.03 mm to 0.5 mm, for example. The conductive wire 50, and the conductive wire 60, have the same diameter, for example. It should be noted that describing diameters to be the same does not only mean they are exactly the same; instead, it also includes cases where they are roughly the same, or specifically their difference amounts to a manufacturing error or so, and thus they are considered the same. For example, the ratio of the diameter R2 of the conductive wire 60 to the diameter R1 of the conductive wire 50, or (R2/R1), is 0.9 or greater but no greater than 1.1, where it may be 0.95 or greater but no greater than 1.05, or 0.98 or greater but no greater than 1.02. The conductive wires 50, 60 are each constituted by a metal wire and an insulating film covering the metal wire. The metal wire is formed by, for example, copper, silver, palladium, or silver-palladium alloy, and the like. The insulating film is formed by, for example, polyester imide or polyamide, and the like.

The terminal electrodes 70*a*, 70*c* are provided on the flange part 14. The terminal electrodes 70*a*, 70*c* extend from the connection face 20, via the exterior face 26, to the mounting face 22, of the flange part 14. The terminal electrodes 70*b*, 70*d* are provided on the flange part 16. The terminal electrodes 70*b*, 70*d* extend from the connection face 30, via the exterior face 36, to the mounting face 32, of the flange part 16. The terminal electrodes 70*a* to 70*d* are each a metal film constituted by layering, for example, a base layer of copper, silver, palladium, or silver-palladium alloy, and the like, and a plating layer provided on top of the base layer comprising a nickel layer and a tin layer.

One end of the conductive wire 50 is connected to the terminal electrode 70*a* at the connection face 20 of the flange part 14, while the other end is connected to the terminal electrode 70*b* at the connection face 30 of the flange part 16. One end of the conductive wire 60 is connected to the terminal electrode 70*c* at the connection face 20 of the flange part 14, while the other end is connected to the terminal electrode 70*d* at the connection face 30 of the flange part 16. As described, the connection faces 20, 30 of the flange parts 14, 16 are faces on which the ends of the conductive wires 50, 60 connect to the terminal electrodes 70*a* to 70*d*, and face the same side. Also, the mounting faces 22, 32 of the flange parts 14, 16 are faces on which the coil component 500 is mounted with a solder, etc.

Figure 3A:
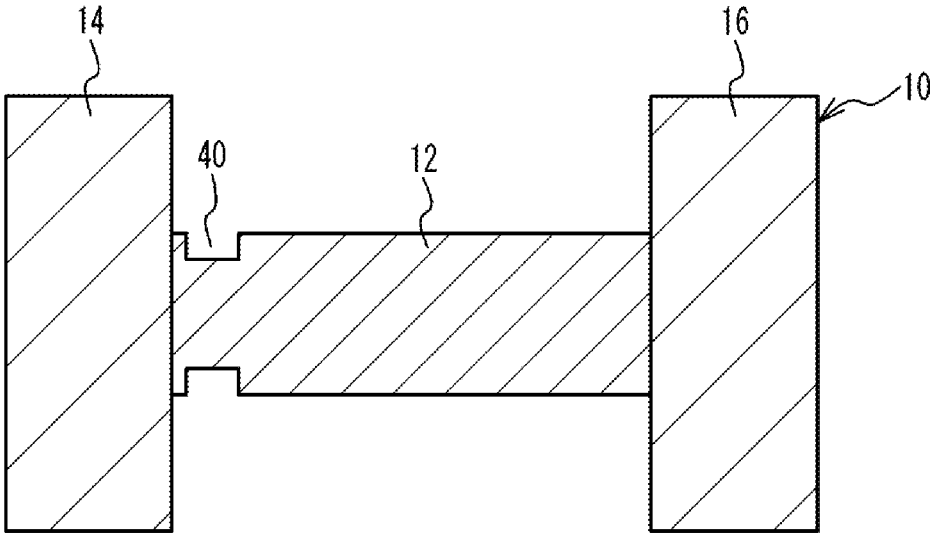
FIGS. 3A to 3C are cross-sectional views illustrating how the coil component pertaining to Example 1 is manufactured.
Figure 3B:
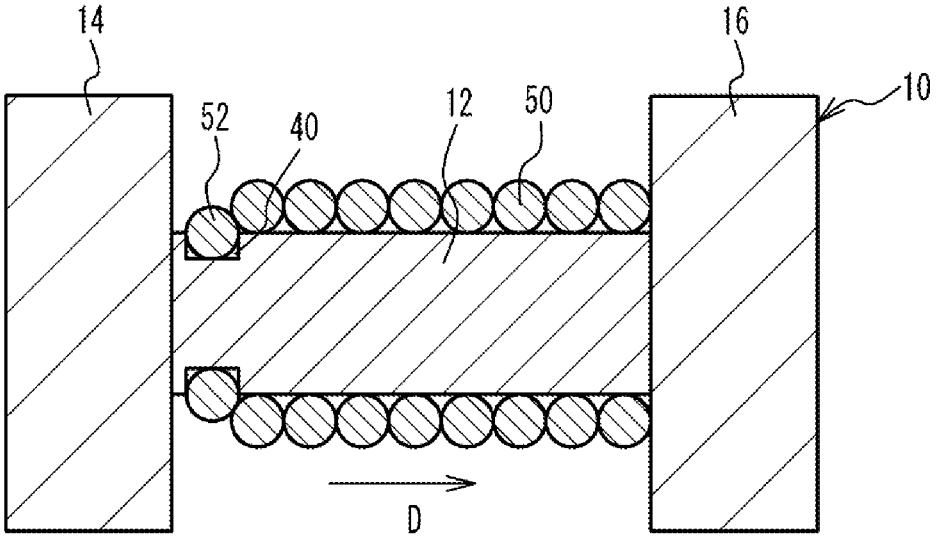
Figure 3C:
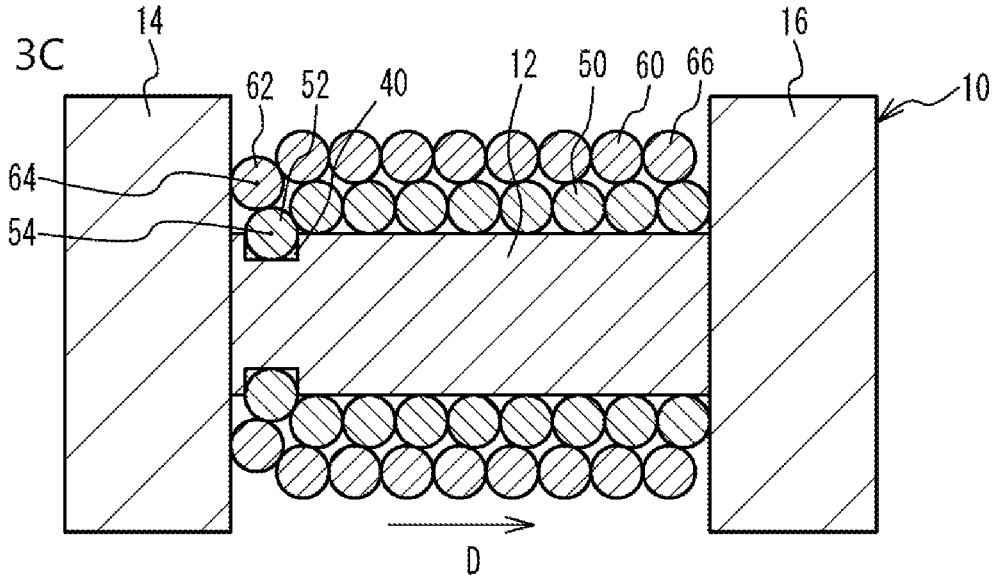

FIGS. 3A to 3C are cross-sectional views illustrating how the coil component pertaining to Example 1 is manufactured. It should be noted that, in FIGS. 3B and 3C, the winding direction of the conductive wires 50, 60 is indicated by an arrow D. As shown in FIG. 3A, a drum core 10 is prepared that includes a winding core 12, a flange part 14 provided at one end of the winding core 12 in the axial direction, and a flange part 16 provided at the other end of the winding core 12 in the axial direction. In Example 1, a drum core 10 whose winding core 12 has a concaved part 40 formed on it, which is a specified distance away from the flange part 14 and is concaved in a direction crossing (such as a direction crossing at right angles) the axial direction of the winding core 12, is prepared. The drum core 10, if formed with a ferrite material, may be formed by molding the material to a desired shape and then heat-treating (sintering) it at approx. 1100° C., for example. The drum core 10, if formed with metal magnetic grains, may be formed by molding to a desired shape a granular composite magnetic material prepared by mixing metal magnetic grains with a resin, and then heat-treating it at approx. 200° C., for example, to harden the resin. Additionally, the drum core 10, if formed with metal magnetic grains, may be formed by compacting multiple metal magnetic grains into a desired shape and then heat-treating it at approx. 800° C., for example, in an oxygen atmosphere, thereby allowing the multiple metal magnetic grains to bind together by means of oxide films formed on the surfaces of the metal magnetic grains. It should be noted that the concaved part 40 may be formed in the stage where a desired shape has been formed, or it may be formed by cutting, etc., following the completion of post-molding heat-treatment.

After the drum core 10 has been prepared, terminal electrodes 70*a*, 70*c* are formed on the flange part 14, while terminal electrodes 70*b*, 70*d* are formed on the flange part 16, which are not illustrated. The terminal electrodes 70*a* to 70*d* may be formed by, for example, bonding metal foils, each constituted by a base layer with a plating layer provided on top, to the flange parts 14, 16 using an adhesive, etc. Also, the terminal electrodes 70*a* to 70*d* may be formed by, for example, using the sputtering method to form base layers on the flange parts 14, 16 and then forming plating layers on top of the base layers. The base layers may be formed by applying a conductive paste.

One end of the conductive wire 50 is connected, at the connection face 20, to the terminal electrode 70*a* formed on the flange part 14, after which, as shown in FIG. 3B, winding of the conductive wire 50 around the winding core 12 is started in such a way that it is fitted in the concaved part 40 of the winding core 12, to wind the conductive wire 50 around the winding core 12 from the flange part 14 toward the flange part 16. In other words, the conductive wire 50 is wound around the winding core 12 from the flange part 14 toward the flange part 16 so that, of the conductive wire 50, the proximate winding segment 52 at the start of winding, which is wound closest to the flange part 14, is fitted in the concaved part 40. Regarding the winding of the conductive wire 50, it is wound in such a way that its adjacent winding segments contact each other. After the winding of the conductive wire 50 around the winding core 12 is completed, the other end of the conductive wire 50 is led out to the connection face 30 of the flange part 16 and connected to the terminal electrode 70*b* formed on the flange part 16. Connecting both ends of the conductive wire 50 to the terminal electrodes 70*a*, 70*b* is performed by means of soldering using an unleaded solder, for example. It should be noted that the connection of one end of the conductive wire 50 to the terminal electrode 70*a* formed on the flange part 14 may be performed after the winding of the conductive wire 50 around the winding core 12 is completed.

Next, one end of the conductive wire 60 is connected, at the connection face 20, to the terminal electrode 70*c* formed on the flange part 14, after which, as shown in FIG. 3C, the conductive wire 60 is wound around the winding core 12 on the exterior side of the conductive wire 50 from the flange part 14 toward the flange part 16. Here, the conductive wire 60 is wound around the winding core 12 in such a way that the center 64 of the cross-section at the proximate winding segment 62 at the start of winding wound closest to the flange part 14, is positioned closer to the flange part 14 side in the axial direction of the winding core 12 than is the center 54 of the cross-section at the proximate winding segment 52 of the conductive wire 50, and that the spacing in the axial direction of the winding core 12, between the center 64 of the cross-section at the proximate winding segment 62 of the conductive wire 60 and the center 54 of the cross-section at the proximate winding segment 52 of the conductive wire 50, becomes smaller than the radius of the conductive wire 50. In Example 1, the conductive wire 50 is wound around the winding core 12 so that the proximate winding segment 52 of the conductive wire 50 is fitted in the concaved part 40 of the winding core 12, and then the conductive wire 60 is wound around the winding core 12 on the exterior side of the conductive wire 50 so that the proximate winding segment 62 of the conductive wire 60 contacts the flange part 14. This way, the conductive wire 60 can be wound around the winding core 12 in such a way that the center 64 of the cross-section at the proximate winding segment 62 of the conductive wire 60 is positioned closer to the flange part 14 side than is the center 54 of the cross-section at the proximate winding segment 52 of the conductive wire 50, and that the spacing in the axial direction of the winding core 12, between the center 64 of the cross-section at the proximate winding segment 62 of the conductive wire 60 and the center 54 of the cross-section at the proximate winding segment 52 of the conductive wire 50, becomes smaller than the radius of the conductive wire 50.

As for the winding of the conductive wire 60, it is wound in such a way that its adjacent winding segments contact each other. After the winding of the conductive wire 60 around the winding core 12 is completed, the other end of the conductive wire 60 is led out to the connection face 30 of the flange part 16 and connected to the terminal electrode 70*d* formed on the flange part 16. Connecting both ends of the conductive wire 60 to the terminal electrodes 70*c*, 70*d* is performed by means of soldering using an unleaded solder, for example. It should be noted that the connection of one end of the conductive wire 60 to the terminal electrode 70*c* formed on the flange part 14 may be performed after the winding of the conductive wire 60 around the winding core 12 is completed.

Figure 4A:
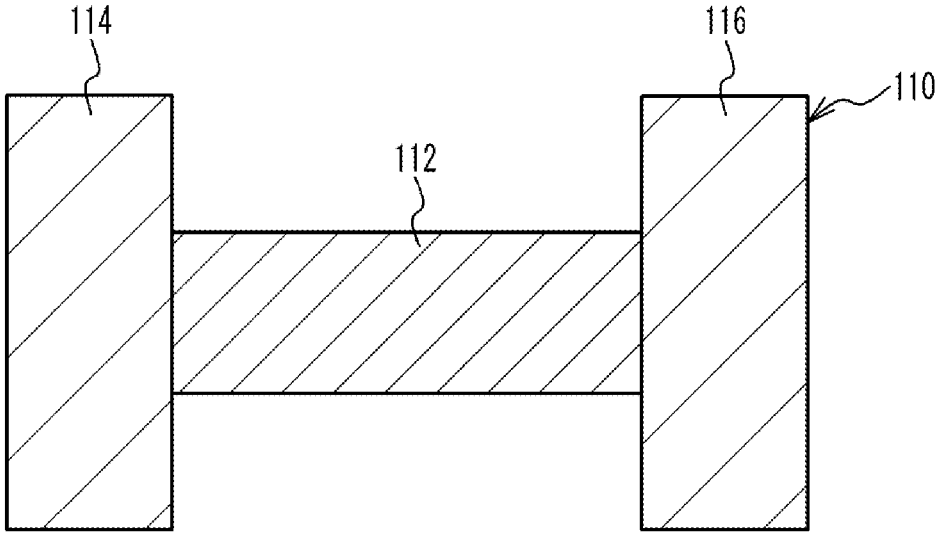
FIGS. 4A to 4C are cross-sectional views illustrating how the coil component pertaining to Comparative Example 1 is manufactured.
Figure 4B:
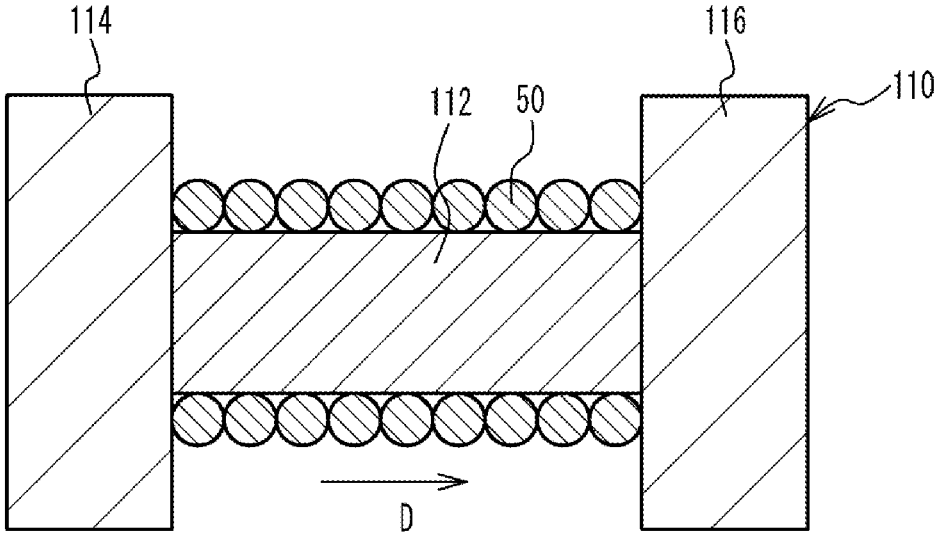
Figure 4C:
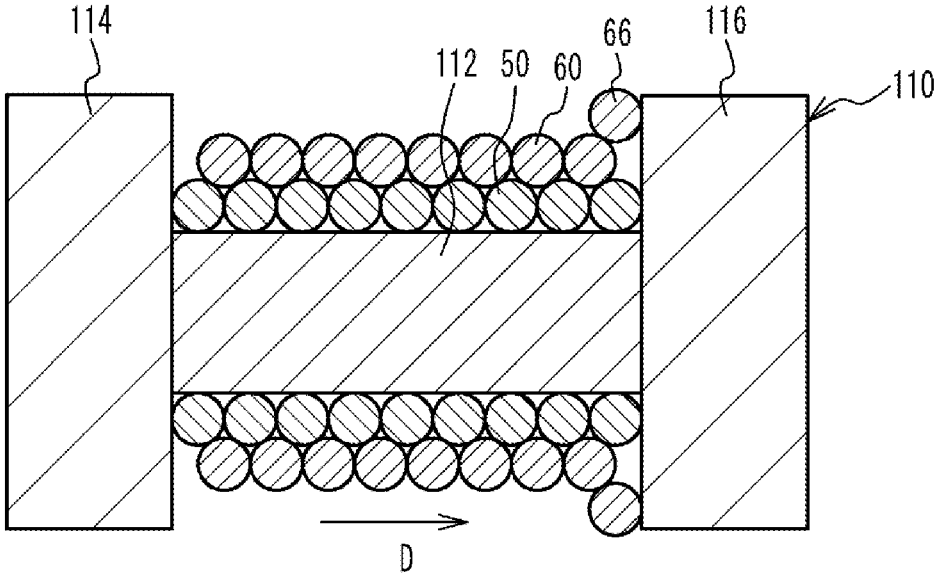

FIGS. 4A to 4C are cross-sectional views illustrating how the coil component pertaining to Comparative Example 1 is manufactured. It should be noted that, in FIGS. 4B and 4C, the winding direction of the conductive wires 50, 60 is indicated by an arrow D. As shown in FIG. 4A, a drum core 110 is prepared that includes a winding core 112 and flange parts 114, 116 provided at both ends of the winding core 112 in the axial direction. In the winding core 112, no concaved part is formed, which is different from the winding core 12 in Example 1. After the drum core 110 has been prepared, terminal electrodes 70*a*, 70*c* are formed on the flange part 114, while terminal electrodes 70*b*, 70*d* are formed on the flange part 116, which are not illustrated.

Next, one end of the conductive wire 50 is connected to the terminal electrode 70*a* formed on the flange part 114, after which, as shown in FIG. 4B, the conductive wire 50 is wound around the winding core 112 from the flange part 114 toward the flange part 116. After the winding of the conductive wire 50 around the winding core 112 is completed, the other end of the conductive wire 50 is led out to the flange part 116 and connected to the terminal electrode 70*b* formed on the flange part 116. It should be noted that the connection of one end of the conductive wire 50 to the terminal electrode 70*a* formed on the flange part 114 may be performed after the winding of the conductive wire 50 around the winding core 112 is completed.

Next, one end of the conductive wire 60 is connected to the terminal electrode 70*c* formed on the flange part 114, after which, as shown in FIG. 4C, the conductive wire 60 is wound around the winding core 112 on the exterior side of the conductive wire 50 from the flange part 114 toward the flange part 116. Since the conductive wire 60 stabilizes when it enters the hollows between the adjacent winding segments of the conductive wire 50, the conductive wire 60 is wound in a manner entering the hollows between the adjacent winding segments of the conductive wire 50. Now, assume that the conductive wire 50 is wound around the winding core 112 by the maximum number of turns possible between the flange part 114 and the flange part 116; in this case, trying to wind the conductive wire 60 on the exterior side of the conductive wire 50 by the same number of turns as the conductive wire 50, may cause the last winding segment 66 of the conductive wire 60 that happens at the very end, to be wound on the exterior side of the winding segments before the last winding segment 66. After the winding of the conductive wire 60 around the winding core 112 is completed, the other end of the conductive wire 60 is led out to the flange part 116 and connected to the terminal electrode 70*d* formed on the flange part 116. It should be noted that the connection of one end of the conductive wire 60 to the terminal electrode 70*c* formed on the flange part 114 may be performed after the winding of the conductive wire 60 around the winding core 112 is completed.

According to Comparative Example 1, the last winding segment 66 of the conductive wire 60 is wound around the winding core 112 on the exterior side of the winding segments before the last winding segment 66. Accordingly, it is required that the flange parts 114, 116 be made larger so that the last winding segment 66 of the conductive wire 60 can be accommodated between the flange part 114 and the flange part 116. As a result, the coil component size increases. In the meantime, lengthening the winding core 112 by the diameter of the conductive wire 60 is also a possibility so that the last winding segment 66 of the conductive wire 60 can be wound in an aligned manner in the same layer as the wound portions before the last winding segment 66; in this case, too, the winding core 112 becomes longer and the coil component size increases as a result.

According to Example 1, on the other hand, the conductive wire 60 is wound around the winding core 12 on the exterior side of the conductive wire 50 in such a way that the center 64 of the cross-section at the proximate winding segment 62 of the conductive wire 60 at the start of winding turning closest to the flange part 14, is positioned closer to the flange part 14 side in the axial direction of the winding core 12 than is the center 54 of the cross-section at the proximate winding segment 52 of the conductive wire 50 at the start of winding turning closest to the flange part 14, as shown in FIG. 3C. Here, the spacing X2 (refer to FIG. 2B) in the axial direction of the winding core 12, between the center 64 of the cross-section at the proximate winding segment 62 of the conductive wire 60 and the center 54 of the cross-section at the proximate winding segment 52 of the conductive wire 50, is made smaller than the radius of the conductive wire 50. This way, the positioning of the last winding segment 66 of the conductive wire 60 on the exterior side of the winding segments before it can be prevented, even when the conductive wire 50 is wound around the winding core 12 by the maximum number of turns possible between the flange part 14 and the flange part 16, and the conductive wire 60 is wound around the winding core 12 on the exterior side of the conductive wire 50 by the same number of turns as the conductive wire 50. The result is that the flange parts 14, 16 need not be increased in size. Also, elongating the length of the winding core 12 within a range shorter than the radius of the conductive wire 60 can prevent the last winding segment 66 of the conductive wire 60 from positioning on the exterior side of the turned portions before it. This means that, according to Example 1, size increase in the coil component 500 can be prevented.

Also, according to Example 1, all wound portions of the conductive wire 60 can be formed in a manner aligned in a single layer. In the case of FIG. 4C under Comparative Example 1, for example, the last winding segment 66 of the conductive wire 60 may shift in such a way that it enters the hollow between adjacent winding segments among the winding segments before the last winding segment 66. In this case, parasitic capacitance may generate and high-frequency characteristics may deteriorate. In Example 1, on the other hand, all winding segments of the conductive wire 60 are formed in a manner aligned in a single layer; this prevents generation of parasitic capacitance, which in turn prevents deterioration in high-frequency characteristics.

Also, according to Example 1, a drum core 10 whose winding core 12 has a concaved part 40 which is positioned away from the flange part 14 and concaved in a direction crossing the axial direction of the winding core 12, is prepared, as shown in FIG. 3A. As shown in FIG. 3B, the conductive wire 50 is wound around the winding core 12 in a manner allowing the proximate winding segment 52 of the conductive wire 50 to fit in the concaved part 40. As shown in FIG. 3C, the conductive wire 60 is wound around the winding core 12 in a manner allowing the proximate winding segment 62 of the conducive wire 60 to contact the flange part 14. This way, winding of the conductive wire 60 around the winding core 12 in such a way that the center 64 of the cross-section at the proximate winding segment 62 of the conductive wire 60 is positioned closer to the flange part 14 side in the axial direction of the winding core 12 than is the center 54 of the cross-section at the proximate winding segment 52 of the conductive wire 50, and that the spacing in the axial direction of the winding core 12 between the center 64 of the cross-section at the proximate winding segment 62 of the conductive wire 60 and the center 54 of the cross-section at the proximate winding segment 52 of the conductive wire 50 becomes smaller than the radius of the conductive wire 50, can be realized with ease.

The concaved part 40 only needs to have such depth and width that can fix the proximate winding segment 52 of the conductive wire 50 in an immovable manner. For example, the width of the concaved part 40 may be 0.5 times or greater but no greater than 1.5 times, or 0.8 times or greater but no greater than 1 times, the diameter of the conductive wire 50. The depth of the concaved part 40 may be 0.2 times or greater but smaller than 1 times, or 0.3 times or greater but no greater than 0.8 times, or 0.4 times or greater but no greater than 0.5 times, the diameter of the conductive wire 50.

The spacing X1 (refer to FIG. 2B) between the flange part 14 and the concaved part 40 only needs to be a spacing that allows the spacing between the center 64 of the cross-section at the proximate winding segment 62 of the conductive wire 60 and the center 54 of the cross-section at the proximate winding segment 52 of the conductive wire 50 to become smaller than the radius of the conductive wire 50. For example, the spacing X1 may be 0.1 times or greater but smaller than 0.5 times, or 0.2 times or greater but no greater than 0.45 times, or 0.3 times or greater but no greater than 0.4 times, the diameter of the conductive wire 60. Additionally, while preferably the concaved part 40 is formed continuously all around the periphery of the winding core 12, it may be partially disrupted or formed only in some portions.

Example 2

Figure 5A:
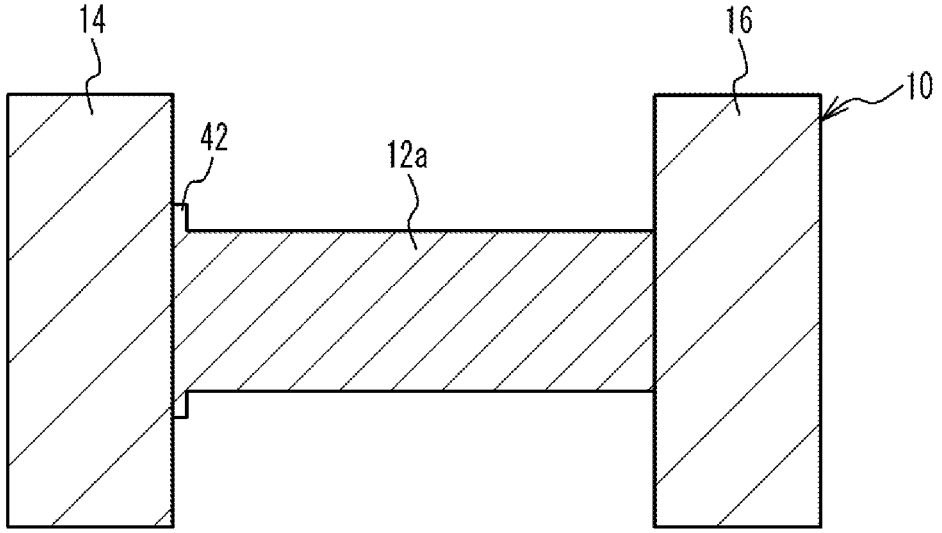
FIGS. 5A to 5C are cross-sectional views illustrating how the coil component pertaining to Example 2 is manufactured.
Figure 5B:
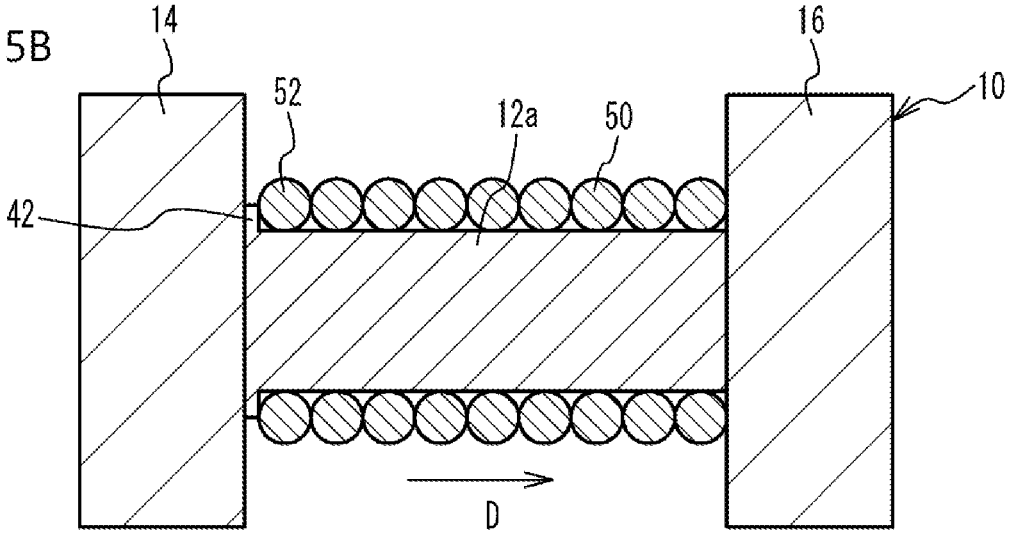
Figure 5C:
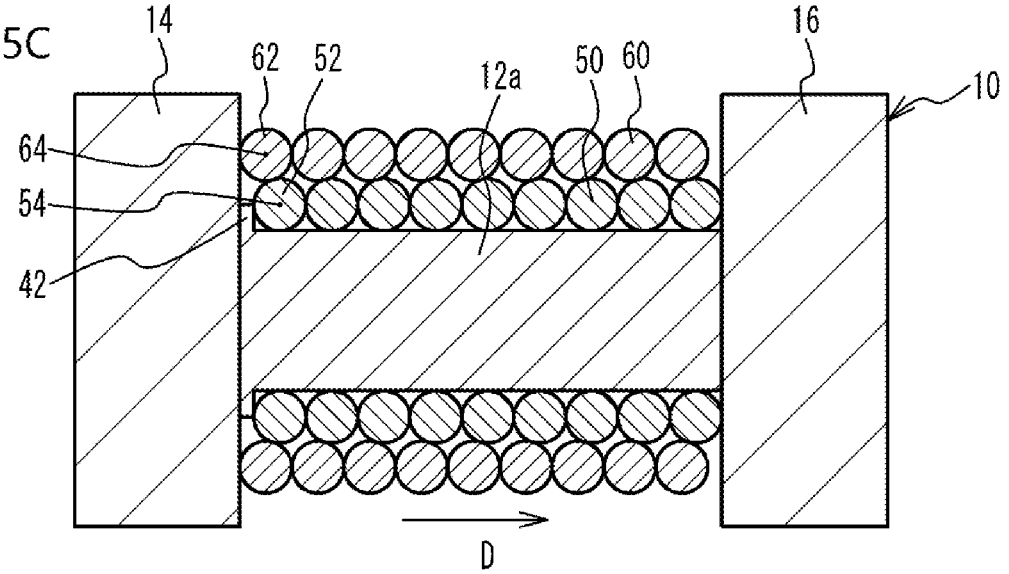

The coil component pertaining to Example 2 is a common mode choke coil just like the one in Example 1, and because its plan views are the same as FIGS. 1A to 1C in Example 1, they are not illustrated or explained. FIGS. 5A to 5C are cross-sectional views illustrating how the coil component pertaining to Example 2 is manufactured. It should be noted that, in FIGS. 5B and 5C, the winding direction of the conductive wires 50, 60 is indicated by an arrow D. As shown in FIG. 5A, a drum core 10 is prepared that includes a winding core 12*a* and flange parts 14, 16 provided at both ends of the winding core 12*a* in the axial direction. In Example 2, a drum core 10 whose winding core 12*a* has a projecting part 42 formed on it, which is contacting the flange part 14 and projecting in a direction crossing (such as a direction crossing at right angles) the axial direction of the winding core 12*a*, is prepared. The projecting part 42 is formed all around the winding core 12*a*, for example. The projecting part 42, just like the concaved part 40 in Example 1, may be formed in the stage where a desired shape has been formed in the drum core 10 forming step, or it may be formed by cutting, etc., following the completion of post-molding heat-treatment. After the drum core 10 has been prepared, terminal electrodes 70*a*, 70*c* are formed on the flange part 14, while terminal electrodes 70*b*, 70*d* are formed on the flange part 16, which are not illustrated.

Next, one end of the conductive wire 50 is connected to the terminal electrode 70*a* formed on the flange part 14, after which, as shown in FIG. 5B, the conductive wire 50 is wound around the winding core 12*a* from the flange part 14 toward the flange part 16 between the projecting part 42 and the flange part 16. In other words, the conductive wire 50 is wound around the winding core 12*a* from the flange part 14 toward the flange part 16 in such a way that the proximate winding segment 52 of the conductive wire 50 contacts the side face of the projecting part 42 on the flange part 16 side which crosses (such as crosses at right angles) the axial direction of the winding core 12*a*. After the winding of the conductive wire 50 around the winding core 12*a* is completed, the other end of the conductive wire 50 is led out to the flange part 16 and connected to the terminal electrode 70*b* formed on the flange part 16. It should be noted that the connection of one end of the conductive wire 50 to the terminal electrode 70*a* formed on the flange part 14 may be performed after the winding of the conductive wire 50 around the winding core 12*a* is completed.

Next, one end of the conductive wire 60 is connected to the terminal electrode 70*c* formed on the flange part 14, after which, as shown in FIG. 5C, the conductive wire 60 is wound around the winding core 12*a* on the exterior side of the conductive wire 50 from the flange part 14 toward the flange part 16. Here, the conductive wire 60 is wound around the winding core 12*a* from the flange part 14 toward the flange part 16 in such a way that the proximate winding segment 62 of the conductive wire 60 contacts the flange part 14. After the winding of the conductive wire 60 around the winding core 12*a* is completed, the other end of the conductive wire 60 is led out to the flange part 16 and connected to the terminal electrode 70*d* formed on the flange part 16. It should be noted that the connection of one end of the conductive wire 60 to the terminal electrode 70*c* formed on the flange part 14 may be performed after the winding of the conductive wire 60 around the winding core 12*a* is completed.

According to Example 2, a drum core 10 whose winding core 12*a* has a projecting part 42 which is contacting the flange part 14 and projecting in a direction that crosses the axial direction of the winding core 12*a*, is prepared, as shown in FIG. 5 A. As shown in FIG. 5B, the conductive wire 50 is wound around the winding core 12*a* between the projecting part 42 and the flange part 16 in a manner allowing the proximate 52 of the conductive wire 50 to contact the side face of the projecting part 42 that crosses the axial direction of the winding core 12*a*. As shown in FIG. 5C, the conductive wire 60 is wound around the winding core 12*a* in a manner allowing the proximate winding segment 62 of the conducive wire 60 to contact the flange part 14. This way, winding of the conductive wire 60 around the winding core 12*a* in such a way that the center 64 of the cross-section at the proximate winding segment 62 of the conductive wire 60 is positioned closer to the flange part 14 side in the axial direction of the winding core 12*a* than is the center 54 of the cross-section at the proximate winding segment 52 of the conductive wire 50, and that the spacing in the axial direction of the winding core 12*a* between the center 64 of the cross-section at the proximate winding segment 62 of the conductive wire 60 and the center 54 of the cross-section at the proximate winding segment 52 of the conductive wire 50 becomes smaller than the radius of the conductive wire 50, can be realized with ease.

The height of the projecting part 42 only needs to be a height that prevents the proximate winding segment 52 of the conductive wire 50 from moving to the flange part 14 side. For example, the height of the projecting part 42 may be 0.2 times or greater but no greater than 1 times, or 0.3 times or greater but no greater than 0.8 times, or 0.4 times or greater but no greater than 0.6 times or 0.5 times, the diameter of the conductive wire 50. The width of the projecting part 42 only needs to be a width that makes the spacing in the axial direction of the winding core 12*a* between the center 64 of the cross-section at the proximate winding segment 62 of the conductive wire 60 and the center 54 of the cross-section at the proximate winding segment 52 of the conductive wire 50, smaller than the radius of the conductive wire 50. For example, the width of the projecting part 42 may be 0.1 times or greater but less than 0.5 times, or 0.2 times or greater but no greater than 0.45 times, or 0.3 times or greater but no greater than 0.4 times, the diameter of the conductive wire 60. Additionally, while preferably the projecting part 42 is formed continuously all around the periphery of the winding core 12*a*, it may be partially disrupted or formed only in some portions.

Example 3

Figure 6A:
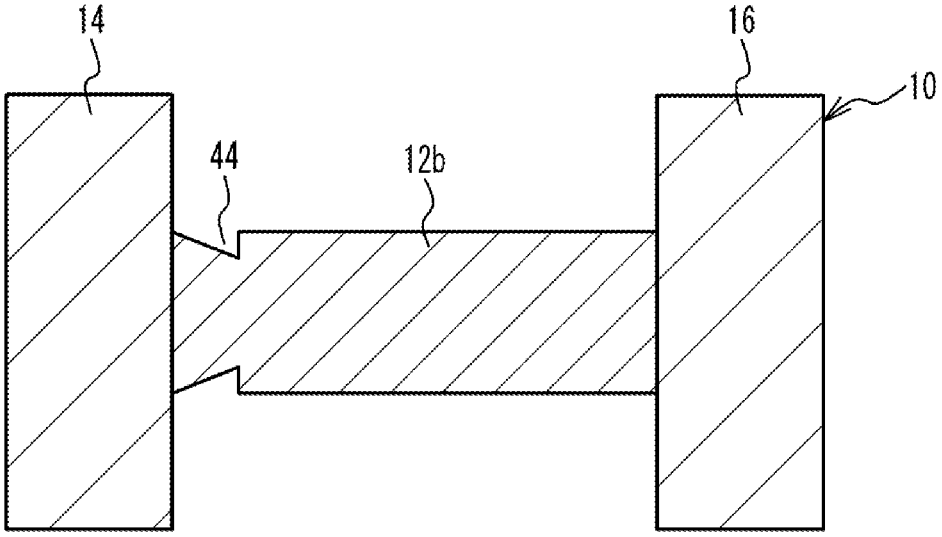
FIGS. 6A to 6C are cross-sectional views illustrating how the coil component pertaining to Example 3 is manufactured.
Figure 6B:
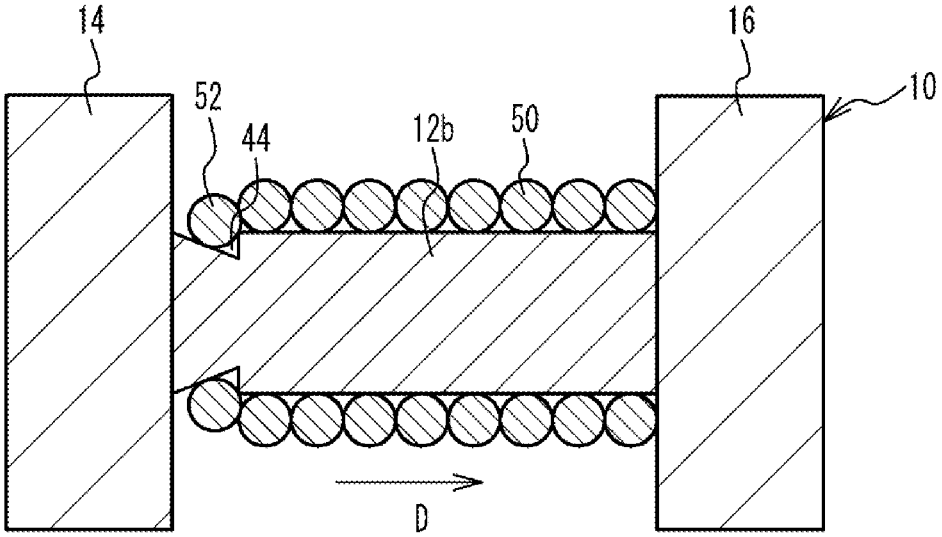
Figure 6C:
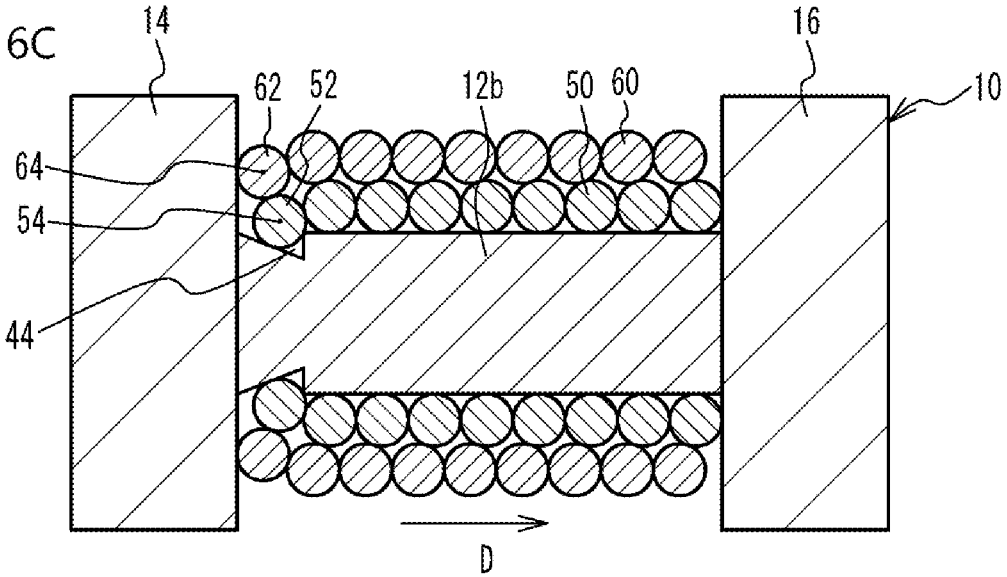

The coil component pertaining to Example 3 is a common mode choke coil just like the one in Example 1, and because its plan views are the same as FIGS. 1A to 1C in Example 1, they are not illustrated or explained. FIGS. 6A to 6C are cross-sectional views illustrating how the coil component pertaining to Example 3 is manufactured. It should be noted that, in FIGS. 6B and 6C, the winding direction of the conductive wires 50, 60 is indicated by an arrow D. As shown in FIG. 6A, a drum core 10 is prepared that includes a winding core 12*b* and flange parts 14, 16 provided at both ends of the winding core 12*b* in the axial direction. In Example 3, a drum core 10 whose winding core 12*b* has a concaved part 44 provided on it, which is contacting the flange part 14 and whose depth gradually increases for points further away from the flange part 14, is prepared. In other words, a drum core 10 whose winding core 12*b* has a concaved part 44 provided on it, which is contacting the flange part 14 and having a face sloped so that the diameter of the winding core 12*b* decreases for points further away from the flange part 14, is prepared. The concaved part 44 is formed all around the winding core 12*b*, for example. The concaved part 44, just like the concaved part 40 in Example 1, may be formed in the stage where a desired shape has been formed in the drum core 10 forming step, or it may be formed by cutting, etc., following the completion of post-molding heat-treatment. After the drum core 10 has been prepared, terminal electrodes 70*a*, 70*c* are formed on the flange part 14, while terminal electrodes 70*b*, 70*d* are formed on the flange part 16, which are not illustrated.

Next, one end of the conductive wire 50 is connected to the terminal electrode 70*a* formed on the flange part 14, after which, as shown in FIG. 6B, the conductive wire 50 is wound around the winding core 12*b* from the flange part 14 toward the flange part 16 in a manner allowing the proximate winding segment 52 of the conductive wire 50 to fit in the concaved part 44. Because the concaved part 44 is shaped so that it becomes gradually deeper for points further away from the flange part 14, having a face sloped so that the diameter of the winding core 12*b* decreases for points further away from the flange part 14, the conductive wire 50 is wound around the winding core 12*b* with the proximate winding segment 52 contacting the side face of the concaved part 44 on the flange part 16 side. After the winding of the conductive wire 50 around the winding core 12*b* is completed, the other end of the conductive wire 50 is led out to the flange part 16 and connected to the terminal electrode 70*b* formed on the flange part 16. It should be noted that the connection of one end of the conductive wire 50 to the terminal electrode 70*a* formed on the flange part 14 may be performed after the winding of the conductive wire 50 around the winding core 12*b* is completed.

Next, one end of the conductive wire 60 is connected to the terminal electrode 70*c* formed on the flange part 14, after which, as shown in FIG. 6C, the conductive wire 60 is wound around the winding core 12*b* on the exterior side of the conductive wire 50 from the flange part 14 toward the flange part 16. Here, the conductive wire 60 is wound around the winding core 12*b* from the flange part 14 toward the flange part 16 in a manner allowing the proximate winding segment 62 of the conductive wire 60 to contact the flange part 14. After the winding of the conductive wire 60 around the winding core 12*b* is completed, the other end of the conductive wire 60 is led out to the flange part 16 and connected to the terminal electrode 70*d* formed on the flange part 16. It should be noted that the connection of one end of the conductive wire 60 to the terminal electrode 70*c* formed on the flange part 14 may be performed after the winding of the conductive wire 60 around the winding core 12*b* is completed.

According to Example 3, a drum core 10 whose winding core 12*b* has a concaved part 44 that includes a face sloped so that the diameter of the winding core 12*b* decreases for points further away from the flange part 14, is prepared, as shown in FIG. 6A. As shown in FIG. 6B, the conductive wire 50 is wound around the winding core 12*b* in a manner allowing the proximate winding segment 52 of the conductive wire 50 to fit in the concaved part 44. As shown in FIG. 6C, the conductive wire 60 is wound around the winding core 12*b* in a manner allowing the proximate winding segment 62 of the conducive wire 60 to contact the flange part 14. This way, winding of the conductive wire 60 around the winding core 12*b* in such a way that the center 64 of the cross-section at the proximate winding segment 62 of the conductive wire 60 is positioned closer to the flange part 14 side in the axial direction of the winding core 12*b* than is the center 54 of the cross-section at the proximate winding segment 52 of the conductive wire 50, and that the spacing in the axial direction of the winding core 12*b* between the center 64 of the cross-section at the proximate winding segment 62 of the conductive wire 60 and the center 54 of the cross-section at the proximate winding segment 52 of the conductive wire 50 becomes smaller than the radius of the conductive wire 50, can be realized with ease. Additionally, the concaved part 40 described in Example 1 is required to have a size corresponding to the diameter of the conductive wire 50; according to the concaved part 44 described in Example 3, on the other hand, the range of conductive wire 50 diameters that can be accommodated increases compared to Example 1.

While the concaved part 44 is provided in contact with the flange part 14 in the illustrated example, it may be provided away from the flange part 14. Additionally, while preferably the concaved part 44 is formed continuously all around the periphery of the winding core 12*b*, it may be partially disrupted or formed only in some portions. The width of the concaved part 44 may be greater than 1 times but smaller than 1.5 times, or 1.2 times or greater but smaller than 1.5 times, the diameter of the conductive wire 50, for example. The depth of the deepest part of the concaved part 44 may be 0.5 times or greater but smaller than 1 times, or 0.6 times or greater but no greater than 0.8 times, the diameter of the conductive wire 50.

Example 4

Figure 7A:
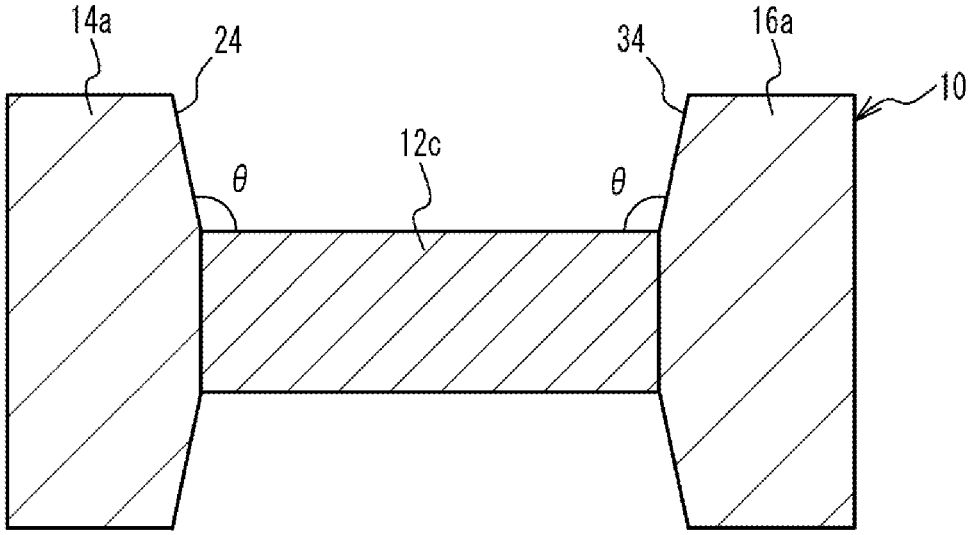
FIGS. 7A to 7C are cross-sectional views illustrating how the coil component pertaining to Example 4 is manufactured.
Figure 7B:
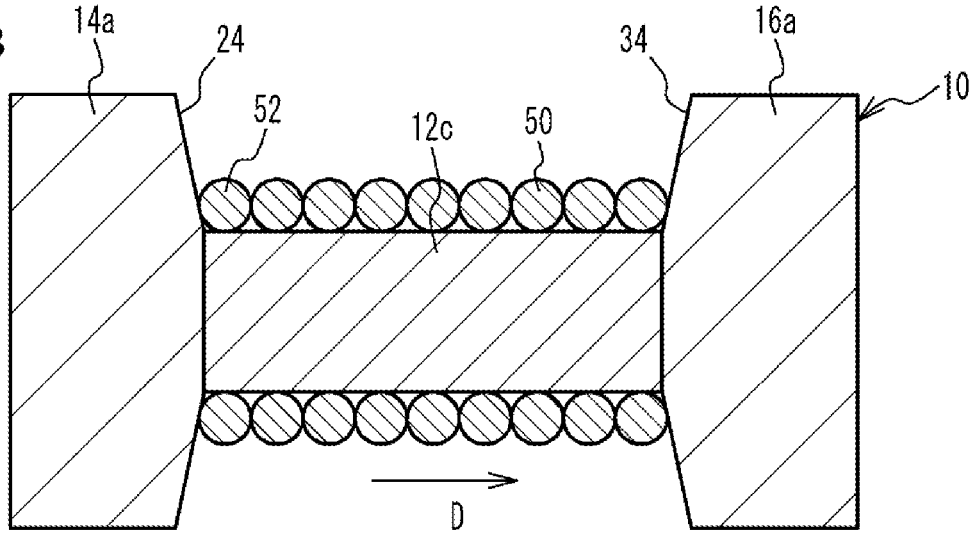
Figure 7C:
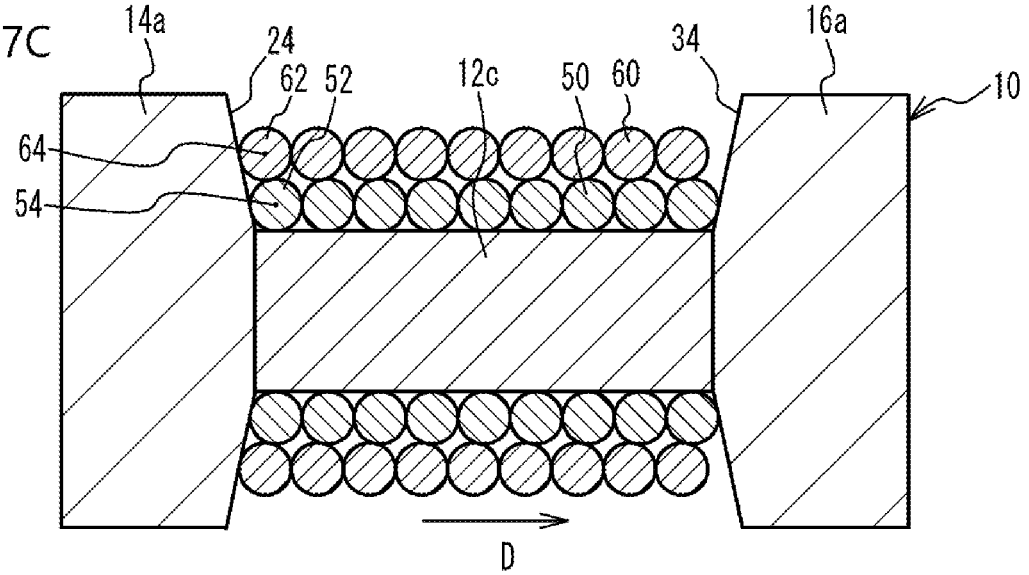

The coil component pertaining to Example 4 is a common mode choke coil just like the one in Example 1, and because its plan views are the same as FIGS. 1A to 1C in Example 1, they are not illustrated or explained. FIGS. 7A to 7C are cross-sectional views illustrating how the coil component pertaining to Example 4 is manufactured. It should be noted that, in FIGS. 7B and 7C, the winding direction of the conductive wires 50, 60 is indicated by an arrow D. As shown in FIG. 7A, a drum core 10 is prepared that includes a winding core 12*c* and flange parts 14*a*, 16*a* provided at both ends of the winding core 12*c* in the axial direction. In Example 4, a drum core 10 whose winding core 12*c* has no concaved part or projecting part provided on it, and which has a slope so that the thicknesses of the flange parts 14*a*, 16*a* in the axial direction of the winding core 12*c* increase for points on the interior faces 24, 34 of the flange parts 14*a*, 16*a* closer to the winding core 12*c*, is prepared. The angle θ of each of the interior faces 24, 34 of the flange parts 14*a*, 16*a*, with respect to the winding core 12*c*, is greater than 90° but smaller than 120°, and it may be 95° or greater but no greater than 115°, or 100° or greater but no greater than 110°, for example. After the drum core 10 has been prepared, terminal electrodes 70*a*, 70*c* are formed on the flange part 14*a*, while terminal electrodes 70*b*, 70*d* are formed on the flange part 16*a*, which are not illustrated Next, one end of the conductive wire 50 is connected to the terminal electrode 70*a* formed on the flange part 14*a*, after which, as shown in FIG. 7B, the conductive wire 50 is wound around the winding core 12*c* from the flange part 14*a* toward the flange part 16*a*. Here, the conductive wire 50 is wound around the winding core 12*c* from the flange part 14*a* toward the flange part 16*a* in a manner allowing the proximate winding segment 52 of the conductive wire 50 to contact the interior face 24 of the flange part 14*a*. After the winding of the conductive wire 50 around the winding core 12*c* is completed, the other end of the conductive wire 50 is led out to the flange part 16*a* and connected to the terminal electrode 70*b* formed on the flange part 16*a*. It should be noted that the connection of one end of the conductive wire 50 to the terminal electrode 70*a* formed on the flange part 14*a* may be performed after the winding of the conductive wire 50 around the winding core 12*c* is completed.

Next, one end of the conductive wire 60 is connected to the terminal electrode 70*c* formed on the flange part 14*a*, after which, as shown in FIG. 7C, the conductive wire 60 is wound around the winding core 12*c* on the exterior side of the conductive wire 50 from the flange part 14*a* toward the flange part 16*a*. Here, the conductive wire 60 is wound around the winding core 12*c* from the flange part 14*a* toward the flange part 16*a* in a manner allowing the proximate winding segment 62 of the conductive wire 60 to contact the interior face 24 of the flange part 14*a*. After the winding of the conductive wire 60 around the winding core 12*c* is completed, the other end of the conductive wire 60 is led out to the flange part 16*a* and connected to the terminal electrode 70*d* formed on the flange part 16*a*. It should be noted that the connection of one end of the conductive wire 60 to the terminal electrode 70*c* formed on the flange part 14*a* may be performed after the winding of the conductive wire 60 around the winding core 12*c* is completed.

According to Example 4, a drum core 10 having a slope so that the thickness of the flange part 14*a* in the axial direction of the winding core 12*c* increases for points on the interior face 24 of the flange part 14*a* closer to the winding core 12*c*, is prepared, as shown in FIG. 7A. As shown in FIG. 7B, the conductive wire 50 is wound around the winding core 12*c* in a manner allowing the proximate winding segment 52 of the conductive wire 50 to contact the interior face 24 of the flange part 14*a*. As shown in FIG. 7C, the conductive wire 60 is wound around the winding core 12*c* in a manner allowing the proximate winding segment 62 of the conducive wire 60 to contact the interior face 24 of the flange part 14*a*. This way, winding of the conductive wire 60 around the winding core 12*c* in such a way that the center 64 of the cross-section at the proximate winding segment 62 of the conductive wire 60 is positioned closer to the flange part 14*a* side in the axial direction of the winding core 12*c* than is the center 54 of the cross-section at the proximate winding segment 52 of the conductive wire 50, and that the spacing in the axial direction of the winding core 12*c* between the center 64 of the cross-section at the proximate winding segment 62 of the conductive wire 60 and the center 54 of the cross-section at the proximate winding segment 52 of the conductive wire 50 becomes smaller than the radius of the conductive wire 50, can be realized with ease. Also, according to Example 4, conductive wires 50, 60 of various sizes can be supported.

In Example 4, the interior face 34 of the flange part 16*a* has a slope in the illustrated example; however, the interior face 34 of the flange part 16*a* may be orthogonal to the axial direction of the winding core 12*c*. Also, while in the illustrated example the entire interior face 24 of the flange part 14*a* has a slope, except for the portion to which the winding core 12*c* is connected, it suffices that, of the interior face 24 of the flange part 14*a*, at least the portions contacted by the proximate winding segment 52 of the conductive wire 50 and proximate winding segment 62 of the conductive wire 60 have a slope. Additionally, while preferably the portions of the interior face 24 of the flange part 14*a* having a slope are formed continuously all around the periphery of the winding core 12*c*, they may include portions without a sloped face along the way, or be formed only partially.

Example 5

Figure 8A:
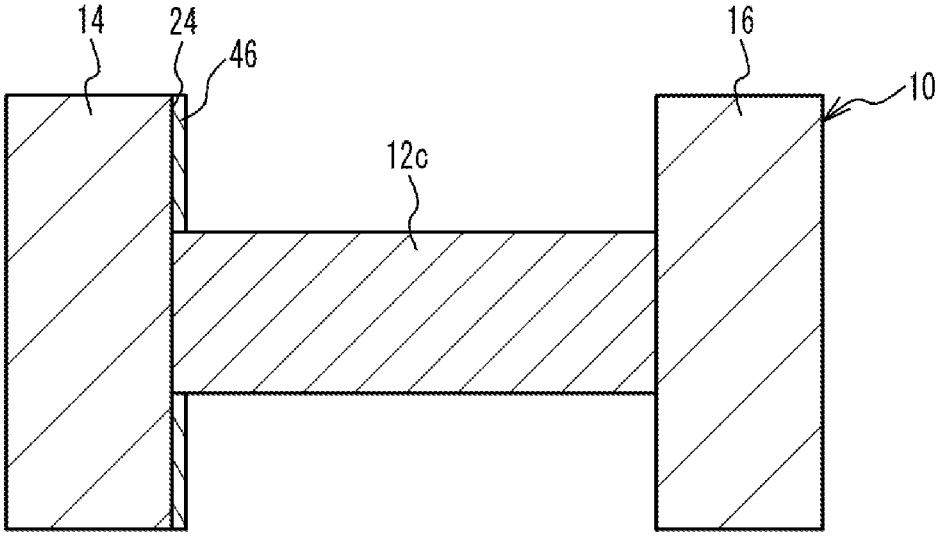
FIGS. 8A to 8C are cross-sectional views illustrating how the coil component pertaining to Example 5 is manufactured.
Figure 8B:
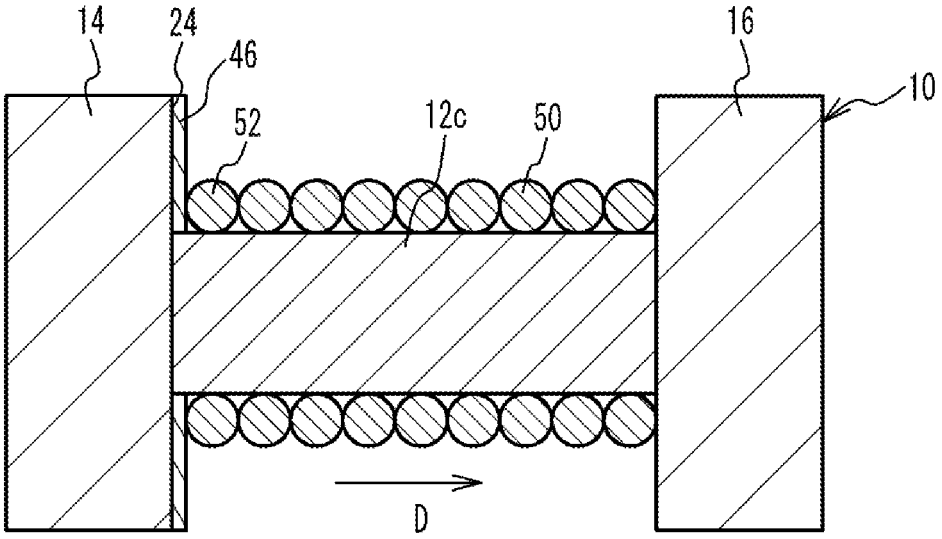
Figure 8C:
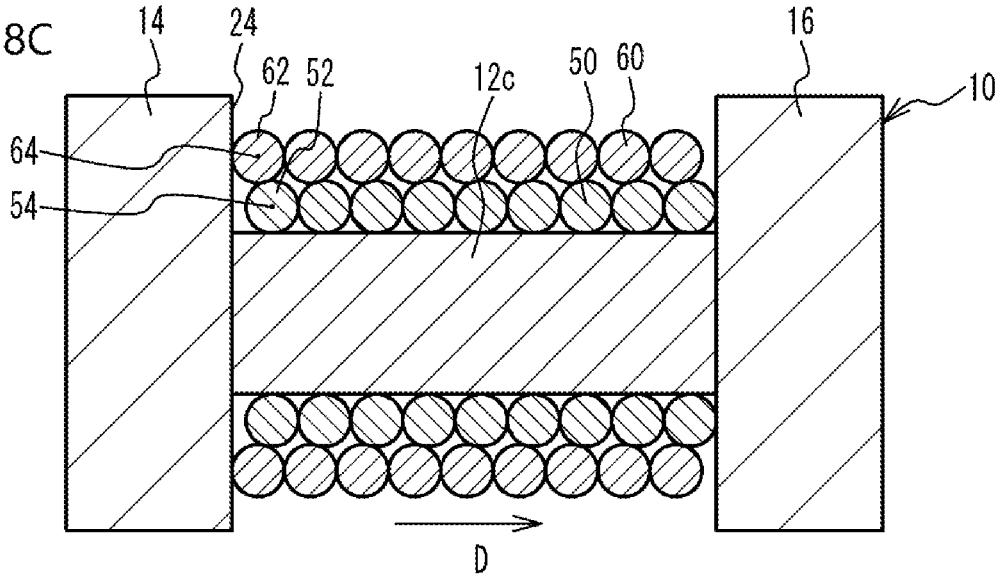

The coil component pertaining to Example 5 is a common mode choke coil just like the one in Example 1, and because its plan views are the same as FIGS. 1A to 1C in Example 1, they are not illustrated or explained. FIGS. 8A to 8C are cross-sectional views illustrating how the coil component pertaining to Example 5 is manufactured. It should be noted that, in FIGS. 8B and 8C, the winding direction of the conductive wires 50, 60 is indicated by an arrow D. As shown in FIG. 8A, a drum core 10 is prepared that includes a winding core 12*c* and flange parts 14, 16 provided at both ends of the winding core 12*c* in the axial direction. Next, a spacer part 46 is formed over a portion of the interior face 24 of the flange part 14 to which the winding core 12*c* is not connected, in a manner contacting the interior face 24. The spacer part 46 is provided all around the periphery of the winding core 12*c*, for example, but it may be disrupted along the way or formed only in some portions. The spacer part 46 may be formed by an insulating member, or it may be formed by a metal member. Because it will be removed as described below, preferably the spacer part 46 is not bonded to the flange part 14. After the drum core 10 has been prepared, terminal electrodes 70*a*, 70*c* are formed on the flange part 14, while terminal electrodes 70*b*, 70*d* are formed on the flange part 16, which are not illustrated, before or after the forming of the spacer part 46.

Next, one end of the conductive wire 50 is connected to the terminal electrode 70*a* formed on the flange part 14, after which, as shown in FIG. 8B, the conductive wire 50 is wound around the winding core 12*c* from the flange part 14 toward the flange part 16 between the spacer part 46 and the flange part 16. In other words, the conductive wire 50 is wound around the winding core 12*c* from the flange part 14 toward the flange part 16 in such a way that the proximate winding segment 52 of the conductive wire 50 contacts the side face of the spacer part 46 which is positioned on the flange part 16 side and crossing (such as crossing at right angles) the axial direction of the winding core 12*c*. After the winding of the conductive wire 50 around the winding core 12*c* is completed, the other end of the conductive wire 50 is led out to the flange part 16 and connected to the terminal electrode 70*b* formed on the flange part 16. It should be noted that the connection of one end of the conductive wire 50 to the terminal electrode 70*a* formed on the flange part 14 may be performed after the winding of the conductive wire 50 around the winding core 12*c* is completed.

Next, the conductive wire 50 is fixed in an immovable manner, after which the spacer part 46 is removed from the drum core 10. The fixing of the conductive wire 50 may be performed using an adhesive, for example. Thereafter, one end of the conductive wire 60 is connected to the terminal electrode 70*c* formed on the flange part 14, after which, as shown in FIG. 8C, the conductive wire 60 is wound around the winding core 12*c* on the exterior side of the conductive wire 50 from the flange part 14 toward the flange part 16. Here, the conductive wire 60 is wound around the winding core 12*c* from the flange part 14 toward the flange part 16 in a manner allowing the proximate winding segment 62 of the conductive wire 60 to contact the flange part 14. After the winding of the conductive wire 60 around the winding core 12*c* is completed, the other end of the conductive wire 60 is led out to the flange part 16 and connected to the terminal electrode 70*d* formed on the flange part 16. It should be noted that the connection of one end of the conductive wire 60 to the terminal electrode 70*c* formed on the flange part 14 may be performed after the winding of the conductive wire 60 around the winding core 12*c* is completed.

According to Example 5, a spacer part 46 is formed around the winding core 12*c* in a manner contacting the flange part 14, as shown in FIG. 8A. As shown in FIG. 8 B, the conductive wire 50 is wound around the winding core 12*c* in a manner allowing the proximate winding segment 52 of the conductive wire 50 to contact the side face of the spacer part 46 crossing the axial direction of the winding core 12*c*. As shown in FIG. 8C, the conductive wire 60 is wound around the winding core 12*c*, after the spacer part 46 has been removed, in a manner allowing the proximate winding segment 62 of the conducive wire 60 to contact the flange part 14. This way, winding of the conductive wire 60 around the winding core 12*c* in such a way that the center 64 of the cross-section at the proximate winding segment 62 of the conductive wire 60 is positioned closer to the flange part 14 side in the axial direction of the winding core 12*c* than is the center 54 of the cross-section at the proximate winding segment 52 of the conductive wire 50, and that the spacing in the axial direction of the winding core 12*c* between the center 64 of the cross-section at the proximate winding segment 62 of the conductive wire 60 and the center 54 of the cross-section at the proximate winding segment 52 of the conductive wire 50 becomes smaller than the radius of the conductive wire 50, can be realized with ease.

The thickness of the spacer part 46 only needs to be a thickness that makes the spacing in the axial direction of the winding core 12*c* between the center 64 of the cross-section at the proximate winding segment 62 of the conductive wire 60 and the center 54 of the cross-section at the proximate winding segment 52 of the conductive wire 50, smaller than the radius of the conductive wire 50. For example, the thickness of the spacer part 46 may be 0.1 times or greater but smaller than 0.5 times, or 0.2 times or greater but no greater than 0.45 times, or 0.3 times or greater but no greater than 0.4 times, the diameter of the conductive wire 60. Also, the spacer part 46 is not necessarily formed over the entire surface of the interior face 24 of the flange part 14, except for the portion to which the winding core 12*c* is connected; instead, it only needs to be formed at least in a portion contacted by the proximate winding segment 52 of the conductive wire 50. Additionally, while preferably the spacer part 46 is provided all around the periphery of the winding core 12*c*, it may be disrupted along the way or formed only in some portions.

Figure 9A:
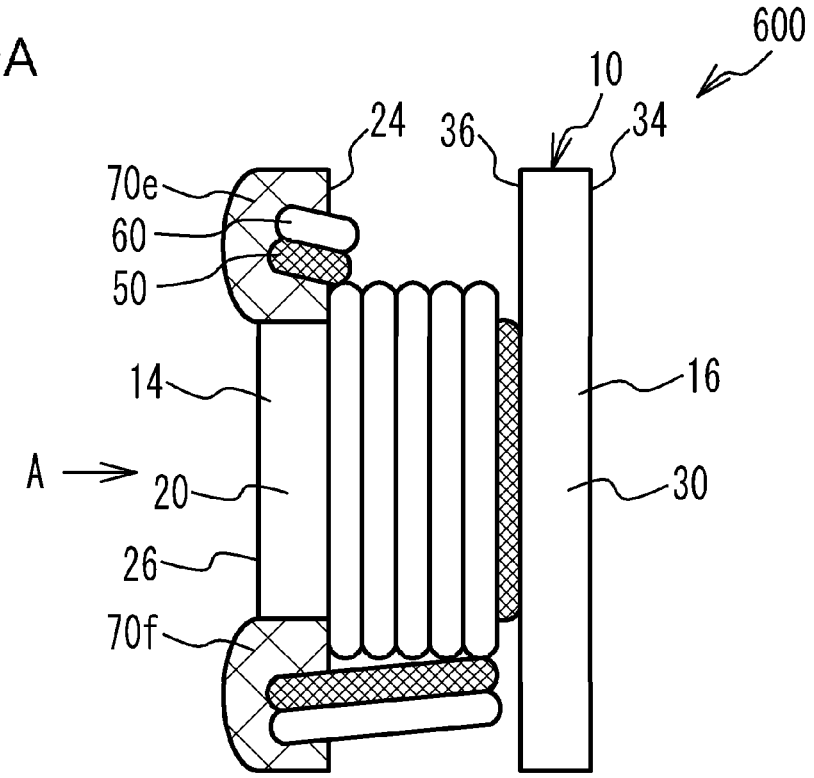
Figure 9B:
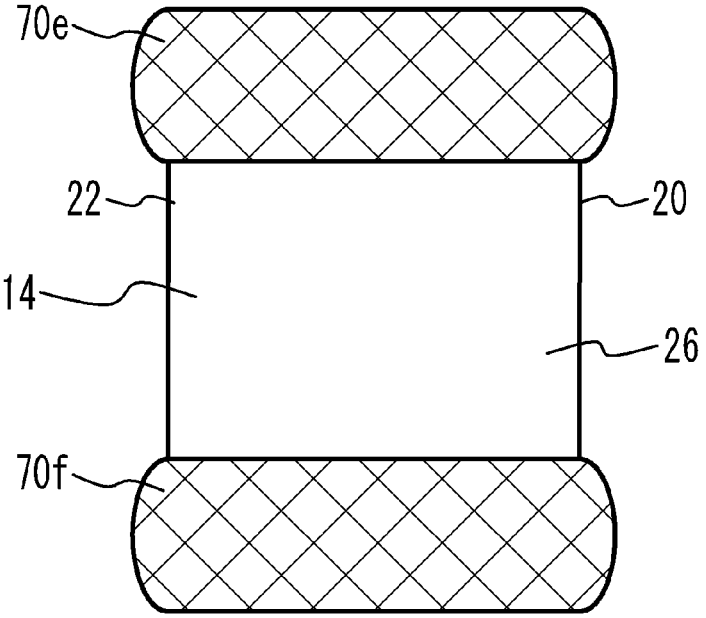
FIG. 9B is a plan view seen from direction A in FIG. 9A, of a coil component for single line.

While Examples 1 to 5 illustrated examples where the coil component is a common mode choke coil, other coil components are also acceptable so long as the coil components have multiple conductive wires layered around the winding core. FIG. 9A is a plan view, while FIG. 9B is a plan view seen from direction A in FIG. 9A, of a coil component for single line. It should be noted that, in FIG. 9A, the illustration of the windings of the conductive wires 50, 60 is simplified for the sake of clarity of figures. Also, in FIGS. 9A and 9B, the conductive wire 50 and terminal electrodes 70*e*, 70*f* are hatched for the sake of clarity of figures.

As shown in FIGS. 9A and 9B, the coil component 600 for single line has terminal electrodes 70*e*, 70*f* provided on the flange part 14, but no terminal electrode provided on the flange part 16. The terminal electrodes 70*e*, 70*f* extend from the connection face 20, via the exterior face 26, to the mounting face 22, of the flange part 14. One end of the conductive wire 50 being wound around the winding core 12 (not illustrated in FIGS. 9A and 9B) of the drum core 10 is connected to the terminal electrode 70*e*, while the other end is connected to the terminal electrode 70*f*. One end of the conductive wire 60 being wound around the winding core 12 on the exterior side of the conductive wire 50 is connected to the terminal electrode 70*e*, while the other end is connected to the terminal electrode 70*f*. The external dimensions of the drum core 10 are 3.2 mm in length dimension, 2.5 mm in width dimension, and 2.4 mm in height dimension, in one example.

With the coil component 600 for a single line, the electrical current input to one of the terminal electrodes 70*e*, 70*f* flows to the other terminal electrode by traveling through both the conductive wires 50, 60, which allows for reduction in resistance. Such coil component 600 is used for DC-DC converters, for example. Also, because deterioration in its high-frequency characteristics is prevented, as explained in Example 1, the coil component 600 can support wide frequency bands for noise elimination.

The foregoing described the examples of the present invention in detail; however, the present invention is not limited to these specific examples, and various modifications and changes may be added so long as doing so does not deviate from the key points of the present invention as described in "What Is Claimed Is."

We claim:

1. A method for manufacturing a coil component, comprising:

a step to prepare a drum core that includes a straight winding core, a first flange part provided on one end of the winding core in an axial direction, and a second flange part provided on an other end of the winding core in the axial direction;

a first winding step where a first conductive wire, being a round wire, is wound around the winding core by a multiple number of turns in a single layer, from the first flange part toward the second flange part, in a manner that adjacent winding segments of the first conductive wire are contacting each other; and a second winding step where a second conductive wire, being a round wire, is wound around the winding core on an outer periphery of the first conductive wire by a same number of turns as in the first winding step in a single layer, from the first flange part toward the second flange part, in a manner that adjacent winding segments of the second conductive wire are contacting each other;

wherein, in the second winding step, the second conductive wire is wound around the winding core in a manner that a center of an axial-direction cross-section of the second conductive wire at a second proximate winding segment which is a winding segment at a start of winding closest to the first flange part, is positioned closer to a first flange part side in the axial direction than a center of an axial-direction cross-section of the first conductive wire at a first proximate winding segment which is a winding segment at a start of winding closest to the first flange part in the first winding step, and that a distance in the axial direction, between the center of the cross-section of the first conductive wire at the first proximate winding segment and the center of the cross-section of the second conductive wire at the second proximate winding segment, becomes more than zero but smaller than an equivalent radius of the first conductive wire on the cross-section.

2. The method for manufacturing a coil component, according to claim 1, wherein:

the step to prepare a drum core comprises having the winding core have a concaved part positioned at a distance away from the first flange part and concaved along a direction crossing the axial direction;

the first winding step comprises arranging the first proximate winding segment to fit in the concaved part; and the second winding step comprises arranging the second proximate winding segment to contact the first flange part.

3. The method for manufacturing a coil component, according to claim 1, wherein:

the step to prepare a drum core comprises having the winding core have a projecting part contacting the first flange part and projecting in a direction crossing the axial direction;

the first winding step comprises arranging the first proximate winding segment to contact a side face, which crosses the axial direction, of the projecting part; and the second winding step comprises arranging the second proximate winding segment to contact the first flange part.

4. The method for manufacturing a coil component, according to claim 1, wherein:

the step to prepare a drum core comprises having the winding core have a concaved part that includes a face sloped so that a diameter of the winding core decreases for points further away from the first flange part;

the first winding step comprises arranging the first proximate winding segment to fit in the concaved part; and the second winding step comprises arranging the second proximate winding segment to contact the first flange part.

5. The method for manufacturing a coil component, according to claim 1, wherein:

the step to prepare a drum core comprises having an interior face, to which the winding core is connected, of the first flange part have a slope so that a thickness of the first flange part in the axial direction increases for points closer to the winding core;

the first winding step comprises arranging the first proximate winding segment to contact the interior face of the first flange part; and the second winding step comprises arranging the second proximate winding segment to contact the interior face of the first flange part.

6. The method for manufacturing a coil component, according to claim 1, wherein:

a step to form a spacer part in contact with the first flange part around the winding core is provided before the first winding step;

a step to remove the spacer part is provided after the first winding step and before the second winding step;

the first winding step comprises arranging the first proximate winding segment to contact a side face, which crosses the axial direction, of the spacer part that has been formed in contact with the first flange part around the winding core; and the second winding step comprises arranging the second proximate winding segment to contact the first flange part after the spacer part has been removed.

7. A method for manufacturing a coil component comprising:

(i) winding a first round conductive wire around a straight winding core in a single layer in an axial direction from a first flange part provided on one end of the winding core, toward a second flange part provided on another end of the winding core; and (ii) winding a second round conductive wire around the winding core on the first round conductive wire in the axial direction by the same number of turns and in the same direction as in step (i) in a single layer in a manner that center B of a cross-section of the second round conductive wire closest to the first flange part is positioned closer to the first flange part than center A of the cross-section of the first round conductive wire closest to the first flange part, and that a distance in the axial direction between centers A and B is greater than zero but smaller than a radius of the first round conductive wire.

* * * * *